US005671773A

United States Patent [19]

Park

[11] Patent Number: 5,671,773

[45] Date of Patent: Sep. 30, 1997

[54] AUTOMATIC FLUID-SUPPLY APPARATUS FOR A BOILER SYSTEM

[75] Inventor: Jae-Gyeong Park, Incheon, Rep. of Korea

[73] Assignee: Daewoo Electronics Co, Ltd., Seoul, Rep. of Korea

[21] Appl. No.: 555,431

[22] Filed: Nov. 9, 1995

[51] Int. Cl.[6] ..... F16K 21/18

[52] U.S. Cl. ..... 137/386; 237/66

[58] Field of Search ..... 137/386, 486, 137/487.5; 237/66

[56] References Cited

U.S. PATENT DOCUMENTS 5,007,583 4/1991 Schwarz ..... 237/66

*Primary Examiner*—Gerald A. Michalsky

*Attorney, Agent, or Firm*—Fish & Richardson, P.C.

[57] ABSTRACT

An automatic fluid-supply apparatus for a boiler system automatically controls an amount of fluid being supplied to a fluid tank of the boiler system. The automatic fluid-supply apparatus is provided with a flux detecting portion which comprises a rotor assembly disposed inside a fluid-supply pipe to rotate in proportion to the flux of the fluid flowing from a fluid-supply source to the fluid tank and a HALL sensor disposed close to the rotor assembly at an outer surface of the fluid tank. The HALL sensor is intermittently turned ON/OFF in response to permanent magnets provided to the rotor assembly. A controller compares the ON/OFF frequency with a preset ON/OFF frequency range and transmits an ON/OFF signal to a solenoid valve.

6 Claims, 3 Drawing Sheets

AUTOMATIC FLUID-SUPPLY APPARATUS FOR A BOILER SYSTEM

BACKGROUND OF THE INVENTION

1. Field of the Invention

The present invention relates to a fluid-supply apparatus for a boiler system, and more particularly to an automatic fluid-supply apparatus for a boiler system which detects flux of the fluid flowing from a fluid-supply source line such as a running water supply line to a fluid tank, compares the detected flux with a preset flux range, and automatically controls an amount of fluid being supplied into the fluid tank.

2. Description of the Prior Arts

Generally, in a boiler system, fluid such as water is heated by the heat generated by combustion of fuel such as gas, petroleum or the like. The heated fluid is circulated by a pump. The heated fluid is utilized for heating a house or a building or for supplying hot water to the house or the building. In the boiler system, the fluid is supplied from a fluid supply source line through a fluid supply pipe to a fluid tank. The fluid supplied to the fluid tank is circulated through a fluid discharging pipe, a heat exchanger and a heat piping system by the operation of the pump, and consequently indoor temperature of the house or the building equipped with the heat piping system is elevated.

In this boiler system, since the fluid supplied from the fluid-supply source line and circulated through the boiler system is directly related to the heating efficiency of the boiler system, it is very important to supply an appropriate amount of fluid to the boiler system.

FIG. 4 shows construction of a prior-art fluid supply apparatus for a boiler system.

As shown in FIG. 4, the prior-art fluid supply apparatus for a boiler system 500 is provided with a fluid-supply pipe 550 connected to a fluid supply source line (not shown), and the fluid supply pipe 550 provides a passage for fluid flowing from the fluid supply source line. A fluid tank 510 is connected to the fluid-supply pipe 550, and the fluid tank 510 receives the fluid supplied through the fluid-supply pipe 550. A fluid discharging pipe 560 is connected to the fluid tank 510, and the fluid discharging pipe 560 discharges the fluid in the fluid tank 510 to a heating system(not shown). The fluid tank 510 is provided with an overflow pipe 540, and the overflow pipe 540 drains out the superfluous fluid in the fluid tank 510. Also, the fluid tank 510 is provided with a fluid level detecting portion 520, the fluid level detecting portion 520 detects the fluid level in the fluid tank 510.

The fluid level detecting portion 530 is provided with a float 520 moving up and down in accordance with changes of the fluid level. A rod 522 is connected to the float 520 and provided with a magnet at one end thereof. The rod 522 moves up and down in accordance with the movement of the float 520. A HALL sensor 524 is fixed at the upper inside wall of the fluid tank 510 and connected to a controller 570. The controller is connected to a solenoid valve 580.

The HALL sensor 524 is turned ON/OFF responding to the magnet of the rod 522. That is, when the magnet approaches within a predetermined distance from the HALL sensor 524, the HALL sensor 524 is turned ON by the magnetic force of the magnet, and the signal generated by the HALL sensor 524 is transmitted to the controller. According to this, the controller operates the solenoid valve 580 to be closed, thereby the fluid supply to the fluid tank 510 is suspended. On the contrary, when the magnet moves away from the HALL sensor 524, the HALL sensor 524 is turned OFF, and the controller operates the solenoid valve to be opened, thereby the fluid supply to the fluid tank 510 is resumed.

In the prior-art fluid-supply apparatus for a boiler system as constructed above, when the fluid level of the fluid tank 510 is below the position of the float 520, since the solenoid valve 580 is opened, the fluid is supplied from the fluid-supply source line to the fluid tank 510. However, when the fluid level of the fluid tank 510 rises to the position of the float 520, since the specific gravity of the float 520 is less than that of the fluid, the float 520 moves up in accordance with the rise of the fluid level. Accordingly, the rod 522 moves upward, and the magnet provided at upper end of the rod 522 approaches to the HALL sensor 524. When the magnet approaches within a predetermined distance to the HALL sensor 524, the HALL sensor 524 is turned ON by the magnetic force of the magnet, and the signal generated by the HALL sensor 524 is transmitted to the controller. According to the transmitted signal, the controller operates the solenoid valve 580 disposed between the fluid-supply source line and the fluid-supply pipe 550 to be closed so that the fluid-supply to the fluid tank 510 is suspended.

Meanwhile, since there is a time-delay of about 3–4 seconds from the time when the HALL sensor 524 starts responding to the magnet to the time when the solenoid valve 580 completely shuts off the fluid-supply pipe 550, the fluid can be oversupplied to the fluid tank 510. In this case, the oversupplied fluid is drained out through the overflow pipe 540.

When the fluid level of the fluid tank 510 descends below the position of the float 520 because of the discharging or the evaporation of the fluid, the float 520 moves down in accordance with the descent of the fluid level, accordingly, the magnet moves away from the HALL sensor 524. The HALL sensor 524 is turned OFF, and the controller operates the solenoid valve 580 to be opened.

However, in the prior-art fluid-supply apparatus for a boiler system as constructed above, since the HALL sensor 524, which is one of the sensitive electrical parts, is disposed at the upper inside wall of the fluid tank 510, a substance such as moisture is apt to stick to the HALL sensor 524, and therefore the operational reliability of the HALL sensor 524 can be lowered.

Further, in the prior-art fluid-supply apparatus for a boiler system, since the overflow pipe 540 to drain out the superfluous fluid in the fluid tank 540 for preventing the fluid from contacting with the HALL sensor has to be provided to the fluid tank 510, the construction of the apparatus is complex end therefore its production cost is high.

In addition, since the superfluous fluid in the fluid tank 510 is drained outside the boiler system through the overflow pipe 540, the drained fluid cannot be reused, and therefore it causes waste of the fluid.

SUMMARY OF THE INVENTION

The present invention is intended to overcome the above-mentioned and numerous other disadvantages and deficiencies of the prior art.

Therefore, it is an object of the present invention to provide an automatic fluid-supply apparatus for a boiler system which detects flux of the fluid flowing from a fluid-supply source line to a fluid tank, compares the detected flux with a preset flux range, and automatically controls an amount of the fluid being supplied to the fluid tank, whereby its operational reliability can be assured, and it can be produced at a relatively low cost and needless waste of fluid can be prevented.

To achieve the above-described object of the present invention, there is provided an automatic fluid-supply apparatus of a boiler system which, in a preferred form, comprises: a fluid-supply pipe connected to a fluid-supply source line and providing a passage for fluid flowing from the fluid-supply source line; a fluid tank connected to the fluid-supply pipe and receiving the fluid being supplied through the fluid-supply pipe; a fluid discharging pipe connected to the fluid tank and discharging the fluid in the fluid tank to a heating system; a fluid-return pipe connected between the fluid tank and the heating system so as to enable the fluid to be circulated from the fluid discharging pipe to the fluid tank; means disposed in the fluid tank for detecting flux of the fluid flowing into the fluid tank; a valve disposed between the fluid-supply source line and the fluid-supply pipe and controlling flow of the fluid therebetween; and a controller connected magnetically to the flux detecting means and electrically connected to the valve, the controller comparing flux detected by the flux detecting means and transmitted thereto with flux range preset therein and transmitting ON/OFF signal to the valve, wherein, when the flux detected by the flux detecting means deviates from the preset flux range, the valve is opened and the fluid is supplied to the fluid tank, and when the detected flux is in the preset flux range, the valve is closed and the fluid-supply is suspended.

The flux detecting means comprises a rotor assembly disposed inside the fluid-supply pipe to rotate in proportion to the flux of the fluid flowing from the fluid-supply source line to the fluid tank and a HALL sensor disposed close to the rotor assembly at an outer surface of the fluid tank. The rotor assembly includes a shaft and a plurality of blades fixed to the shaft at regular angular intervals and the respective blade is provided with a permanent magnet at an edge portion thereof.

One end of the fluid-supply pipe is extended upwardly through a bottom of the fluid tank, the fluid-supply pipe further comprises a first and a second one-way bearing disposed facing each other at a distal end of an inner wall thereof, and both end portions of the shaft are respectively inserted into the first and the second one-way bearing.

The HALL sensor is intermittently turned ON/OFF in response to the permanent magnet in accordance with rotation of the rotor assembly and the ON/OFF signal is transmitted to the controller.

According to the above preferred form of the present invention, the fluid is supplied from the fluid-supply source line through the fluid-supply pipe to the fluid tank. The fluid from the fluid tank to the fluid tank is circulated through the fluid discharging pipe, the heat exchanger, the heat piping system by the operation of a pump and the fluid-return pipe.

The fluid flow through the fluid tank causes the rotor assembly disposed inside the fluid-supply pipe to rotate. When the rotor assembly rotates, the permanent magnet provided at the edge portion of the respective blade of the rotor assembly intermittently approaches to and recedes from the HALL sensor, thereby the HALL sensor is intermittently turned ON/OFF.

When the fluid tank is full of the fluid, rotating speed of the rotor assembly is maintained uniform and, therefore, the ON-OFF frequency of the HALL sensor is also maintained uniform within a preset ON-OFF frequency range. According to this, the controller maintains the valve closed, and accordingly the fluid-supply to the fluid tank is suspended.

On the other hand, when the fluid level of the fluid tank descends below the position of the rotor assembly, the rotating speed of the rotor assembly by the flowing fluid decreases to zero, therefore, the ON-OFF frequency of the HALL sensor also decreases to zero, deviating the ON-OFF frequency range. According to this, the controller opens the valve, and accordingly the fluid starts to be supplied to the fluid tank.

When the fluid tank is being filled with the fluid by the above fluid-supply again, the rotating speed of the rotor assembly by the flowing fluid increases, therefore the ON-OFF frequency of the HALL sensor also increases. When the ON-OFF frequency gets into the preset range, the controller closes the valve again.

Therefore, according to the present invention as constructed above, since the HALL sensor is disposed outside the wall of the fluid tank, that is, the HALL sensor is separated from moisture inside the tank by the wall of the fluid tank, the operational reliability of the HALL sensor 524 can be maintained, and therefore stable operation of the boiler system can be assured.

Further, according to the present invention as constructed above, since an element such as an overflow pipe to drain out the superfluous fluid in the fluid tank doesn't have to be prepared in the fluid tank, the construction of the fluid-supply apparatus is relatively simple and therefore its production cost is relatively low.

In addition, since there is no superfluous fluid drained outside the boiler system, there is no waste of fluid.

BRIEF DESCRIPTION OF THE DRAWINGS

The present invention may be better understood and its numerous objects and advantages will be more apparent to those skilled in the art by reference to the accompanying drawings in which.

DESCRIPTION OF THE PREFERRED EMBODIMENTS

The preferred embodiments of this invention will be described in detail with reference to the accompanying drawings.

Hereinafter, the present invention will be described in detail with reference to the accompanying drawings.

Figure 1:
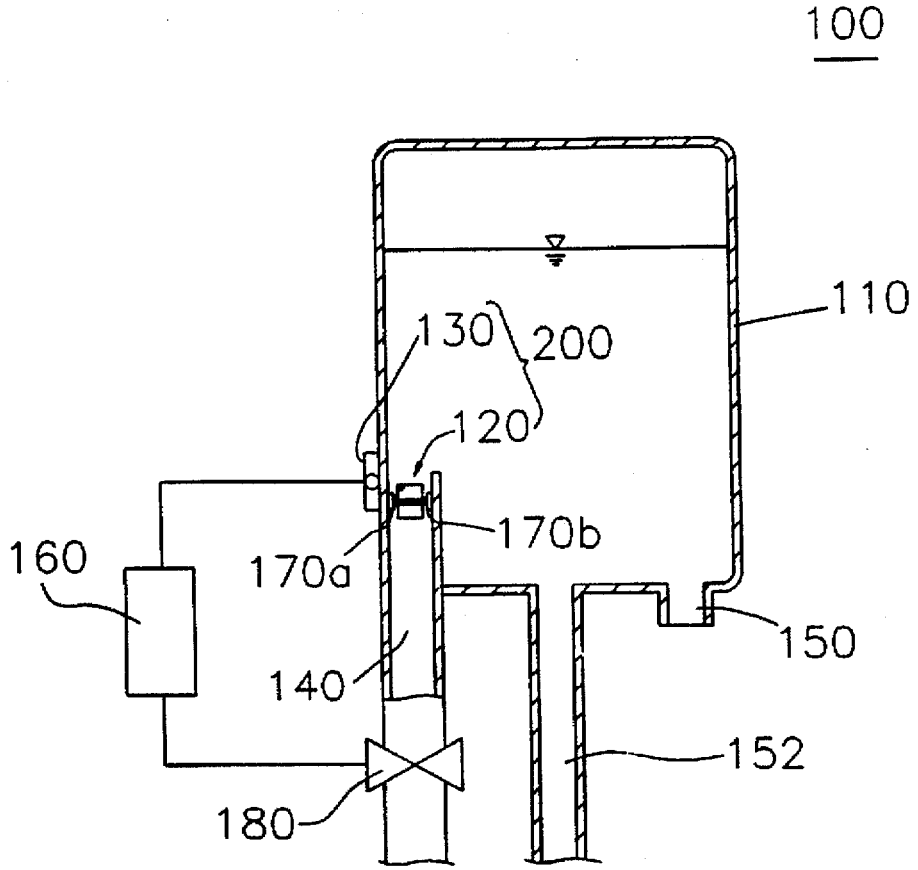
FIG. 1 is a schematic view showing a preferred embodiment of an automatic fluid-supply apparatus for a boiler system according to the present invention.
Figure 2:
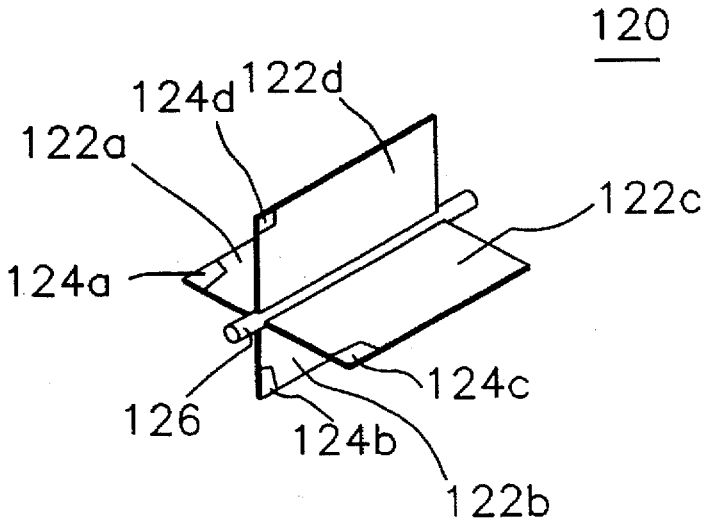
FIG. 2 is an enlarged perspective view of a rotor assembly shown in FIG. 2.
Figure 3:
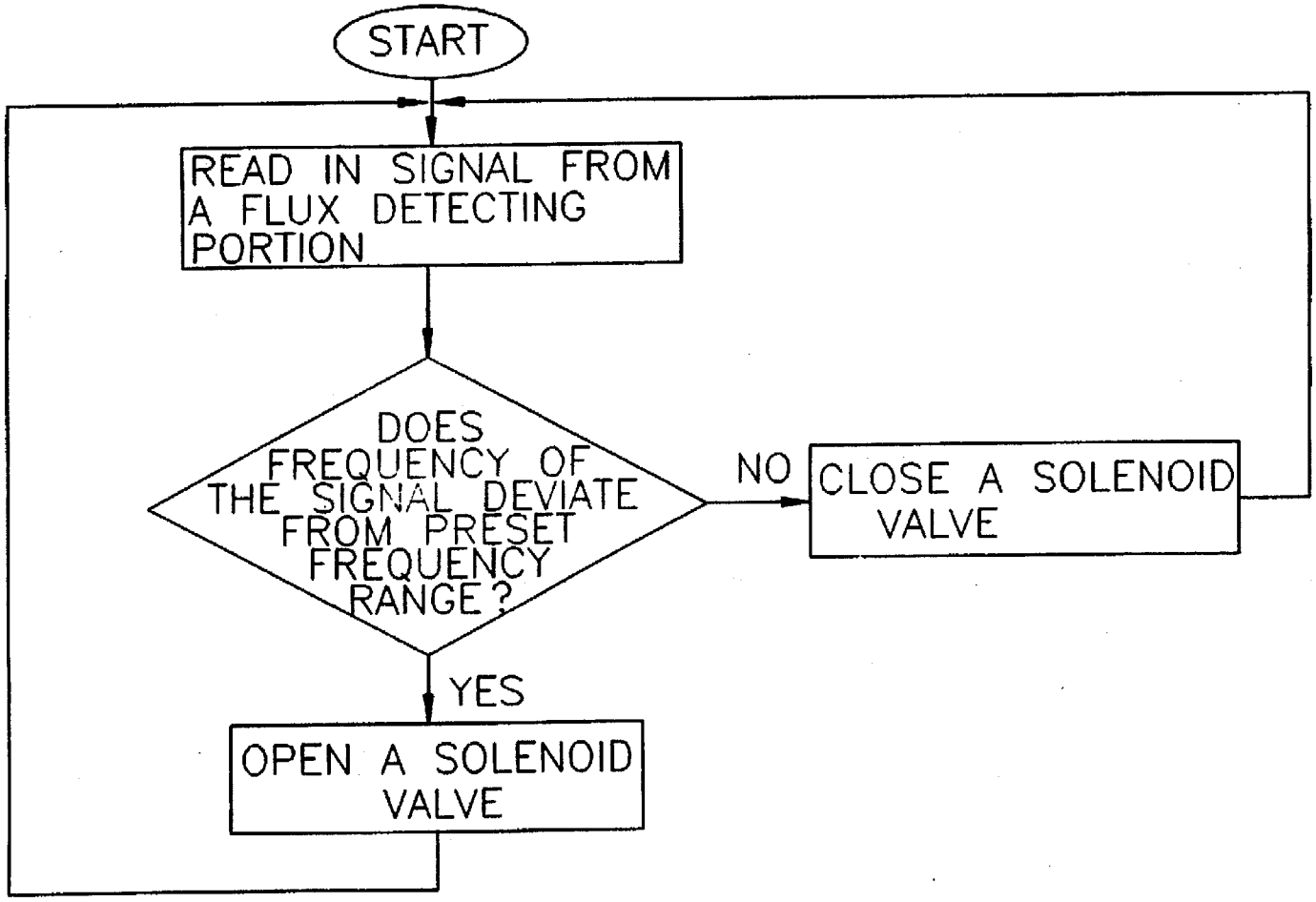
FIG. 3 is a flow chart showing control process of a controller of a preferred embodiment of an automatic fluid-supply apparatus for a boiler system according to the present invention.
Figure 4:
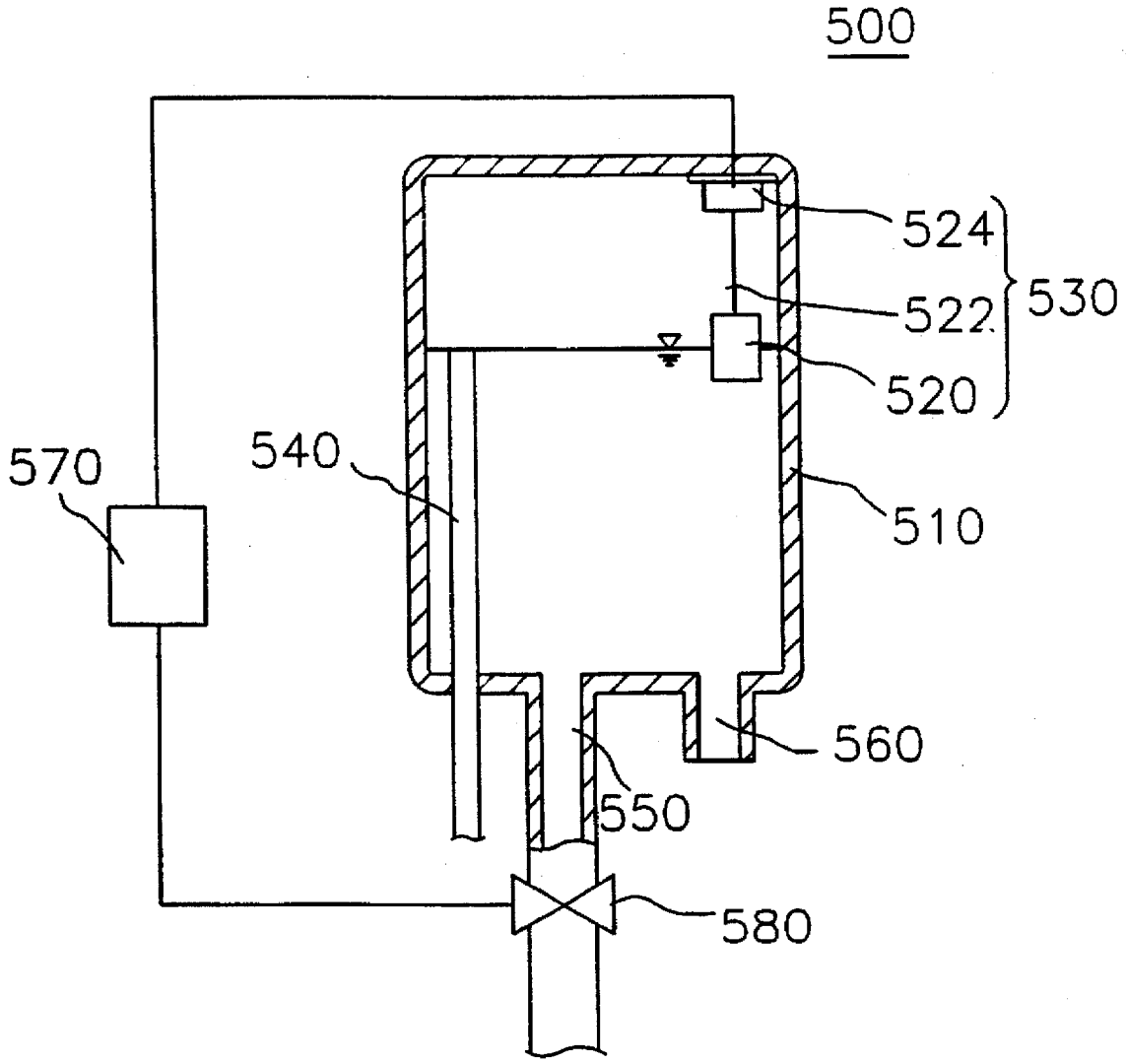
FIG. 4 (PRIOR ART)
FIG. 4 is a schematic view showing a prior-art fluid-supply apparatus for a boiler system.

In FIGS. 1 to 3, there is illustrated a preferred embodiment of an automatic fluid-supply apparatus 100 for a boiler system according to the present invention.

Referring now to FIGS. 1 to 3, the automatic fluid-supply apparatus 100 for a boiler system according to the present invention is provided with a fluid-supply pipe 140, a fluid tank 110, a fluid discharging pipe 150, a fluid-return pipe 152 a flux detecting portion 200, a solenoid valve 180 and a controller 160.

The fluid-supply pipe 140 is connected to a fluid-supply source line (not shown) and provides a passage for fluid flowing from the fluid-supply source line. A solenoid valve 180, which controls the flux of the fluid flowing through the fluid-supply pipe 140, is provided between the fluid-supply source line and the fluid-supply pipe 140. The fluid tank 110 is connected to the fluid-supply pipe 140 and receives the fluid being supplied through the fluid-supply pipe 140. The fluid discharging pipe 150 is connected to the fluid tank 110 and discharges the fluid in the fluid tank 110 to a heating system(not shown). The fluid out of the heating system flows into the fluid tank 110 through the fluid-return pipe 152.

The flux detecting portion 200, which detects flux of the fluid flowing in the fluid tank 110, comprises a rotor assembly 120 disposed inside the fluid tank 110 to rotate in proportion to the flux of the fluid flowing in the fluid tank 110 and a HALL sensor in disposed close to the rotor assembly 120 at an outer surface of the fluid tank 110. As shown in FIG. 2, the rotor assembly 120 includes a shaft 126 and a plurality of blades 122*a*, 122*b*, 122*c* and 122*d* fixed to the shaft 126 at regular angular intervals and the respective blades 122*a*, 122*b*, 122*c* and 122*d* are provided with permanent magnets 124*a*, 124*b*, 124*c* and 124*d* at edge portions of the plurality of blades.

In FIG. 2, there is illustrated the rotor assembly 120 having four blades 122*a*, 122*b*, 122*c* and 122*d*. However, the rotor assembly 120 is able to have up to six blades. In this case, since the number of reactions between the magnets 124*a*, 124*b*, 124*c* and 124*d* and the HALL sensor 130 per a revolution of the rotor assembly 200 increases, relatively precise fluid-supply control based on more detailed data comparison can be performed.

One end of the fluid-supply pipe 140 is extended upwardly through the bottom of the fluid tank 110. First and second one-way bearings 170*a* and 170*b* are disposed facing each other at a distal end of an inner wall of the fluid-supply pipe 140. Both end portions of the shaft 126 are respectively inserted into the first and the second one-way bearings 170*a* and 170*b*.

The shaft 126 of the rotor assembly 200 is supported by the first and the second one-way bearings in such a manner that it rotates only in one direction. Therefore, when the fluid flows through the fluid-supply pipe 140 into the fluid tank 110, the rotor assembly 200 rotates only in one direction.

The HALL sensor 130 is intermittently turned ON/OFF in response to the permanent magnets 124*a*, 124*b*, 124*c* and 124*d* in accordance with rotation of the rotor assembly 120.

The controller 160 is connected to the HALL sensor 130 and the solenoid valve 180. The controller 160 compares the ON/OFF frequency detected by the flux detecting portion with a frequency range preset therein and transmits ON/OFF signals to the solenoid valve 180.

Hereinafter, the operation of the preferred embodiment of the automatic fluid-supply apparatus 100 of a boiler system according to the present invention having the above construction will be described.

The fluid is supplied from the fluid-supply source line through the fluid-supply pipe 140 to the fluid tank 110. The fluid from the fluid tank 110 to the fluid tank 110 is circulated through the fluid discharging pipe 150, a heat exchanger(not shown), a heat piping system(not shown) by the operation of a pump and the fluid-return pipe 152.

When the fluid flows through the fluid-supply pipe 140, the rotor assembly 120 disposed inside the fluid-supply pipe 140 rotates in accordance with the flowing of the fluid. When the rotor assembly 120 rotates, the permanent magnets 124*a*, 124*b*, 124*c* and 124*d* provided at the edge portions of the respective blades 122*a*, 122*b*, 122*c* and 122*d* of the rotor assembly 120 intermittently approaches to and recedes from the HALL sensor 130, thereby the HALL sensor 130 is intermittently turned ON/OFF.

When the fluid tank 110 is full of the fluid, rotating speed of the rotor assembly 120 by the flowing fluid is maintained uniform since the fluid flows uniformly from the fluid discharging pipe 150 to the fluid-return pipe 152, therefore the ON-OFF frequency of the HALL sensor 130 is also maintained uniform in a present ON-OFF frequency range. According to this, the controller 160 maintains the valve closed, and accordingly, the fluid-supply to the fluid tank 110 is suspended.

On the other hand, when the fluid level of the fluid tank 110 descends below the position of the rotor assembly 120, rotating speed of the rotor assembly 120 by the flowing fluid decreases to zero, therefore, the ON-OFF frequency of the HALL sensor 130 also decreases to zero, deviating the preset ON-OFF frequency range. According to this, the controller 160 opens the valve, and accordingly the fluid starts to be supplied to the fluid tank 110.

When the fluid tank 110 is being filled with the fluid by the above fluid-supply again, rotating speed of the rotor assembly 120 by the flowing fluid increases, therefore, the ON-OFF frequency of the HALL sensor 130 also increases. When the ON-OFF frequency goes in the preset ON-OFF frequency range, the controller 160 closes the valve again.

In FIG. 3, there is illustrated a flow chart showing control process of the controller 160 in a boiler system having the automatic fluid-supply apparatus 100 according to the present invention.

As shown in FIG. 3, in the controller 160, the ON/OFF frequency range of the HALL sensor 130, which represents that the boiler system is in a normal operational state, is preset. When the boiler system operates, the ON/OFF frequency of the HALL sensor 130 is transmitted to the controller 160. The controller 160 compares the transmitted ON/OFF frequency with the preset ON/OFF frequency range. When the transmitted ON/OFF frequency deviates from the preset ON/OFF frequency range, the controller 160 transmits an open-signal to the solenoid valve 180. Accordingly, the solenoid valve 180 is opened and the fluid is supplied to the fluid tank 110.

When the transmitted ON/OFF frequency is in the preset ON/OFF frequency range, the controller 160 transmits a close-signal to the solenoid valve 180. Accordingly, the solenoid valve 180 is closed and the fluid is not supplied to the fluid tank 110.

The control process of the controller described above is repeated as long as the boiler operates.

As described above, according to the present invention as constructed above, since the HALL sensor 130 is disposed outside the wall of the fluid tank 110, that is, the HALL sensor 130 is separated from moisture inside the tank 110 by the wall of the fluid tank 110, the operational reliability of the HALL sensor 130 can be maintained, and therefore stable operation of the boiler system can be assured.

Further, according to the present invention as constructed above, since an element such as an overflow pipe to drain out the superfluous fluid in the fluid tank doesn't have to be prepared in the fluid tank, the fluid-supply apparatus can be constructed relatively simple and therefore it can be produced at a relatively low cost.

In addition, since there is no superfluous fluid to be drained outside the boiler system, there is no waste of fluid.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. An automatic fluid-supply apparatus for a boiler system comprising:

a fluid-supply pipe connected to a fluid-supply source and providing a passage for fluid flowing from the fluid-supply source line;

a fluid tank connected to the fluid-supply pipe and receiving the fluid being supplied through the fluid-supply pipe;

a fluid discharging pipe connected to the fluid tank and discharging the fluid in the fluid tank to a heating system;

a fluid-return pipe for returning the fluid from the fluid discharging pipe to the fluid tank;

means disposed in the fluid tank and for detecting flux of the fluid flowing in the fluid tank;

a valve disposed between the fluid-supply source line and the fluid-supply pipe and controlling flow of the fluid therebetween; and a controller magnetically connected to the flux detecting means and electrically connected to the valve so as to detect ON-OFF frequency, and for comparing whether the detected ON-OFF frequency is in an ON-OFF frequency range to thereby open or close the valve, the ON-OFF frequency range being preset in the controller.

2. The automatic fluid-supply apparatus for a boiler system according to claim 1, wherein the flux detecting means comprises a rotor assembly disposed inside the fluid tank to rotate in proportion to the flux of the fluid flowing in the fluid tank and a HALL sensor disposed closely to the rotor assembly at an outer surface of the fluid tank.

3. The automatic fluid-supply apparatus for a boiler system according to claim 2, wherein the rotor assembly includes a shaft and a plurality of blades fixed to the shaft at regular angular intervals and each of the plurality of blades is provided with a permanent magnet at an edge portion thereof.

4. The automatic fluid-supply apparatus for a boiler system according to claim 3, wherein one end of the fluid-supply pipe is extended upwardly through the bottom of the fluid tank, the fluid-supply pipe further comprises first and second one-way bearing disposed facing each other at an distal end of an inner wall thereof, and both end portions of the shaft are inserted into the first and the second one way bearing, respectively.

5. The automatic fluid-supply apparatus for a boiler system according to claim 3, wherein the HALL sensor is intermittently turned ON/OFF in response to the permanent magnet in accordance with rotation of the rotor assembly so as to transmit an ON/OFF signal to the controller.

6. The automatic fluid-supply apparatus for a boiler system according to claim 3, wherein the rotor assembly has four blades.

* * * * *